US007549480B2

(12) United States Patent
Lohbeck

(10) Patent No.: US 7,549,480 B2
(45) Date of Patent: Jun. 23, 2009

(54) DEVICE FOR PERFORMING A DOWNHOLE OPERATION

(75) Inventor: Wilhelmus Christianus Maria Lohbeck, Rijswijk (NL)

(73) Assignee: Shell Oil Company, Houston, TX (US)

( * ) Notice: Subject to any disclaimer, the term of this patent is extended or adjusted under 35 U.S.C. 154(b) by 305 days.

(21) Appl. No.: 10/493,293

(22) PCT Filed: Oct. 23, 2002

(86) PCT No.: PCT/EP02/11898

§ 371 (c)(1),
(2), (4) Date: Aug. 30, 2004

(87) PCT Pub. No.: WO03/036018

PCT Pub. Date: May 1, 2003

(65) Prior Publication Data

US 2005/0000687 A1 Jan. 6, 2005

(30) Foreign Application Priority Data

Oct. 23, 2001 (EP) ..... 01204031

(51) Int. Cl.
*E21B 23/00* (2006.01)

(52) U.S. Cl. ..... 166/383; 166/212

(58) Field of Classification Search ..... 166/207, 166/212, 277, 383, 384
See application file for complete search history.

(56) References Cited

U.S. PATENT DOCUMENTS

| | | | | |
|---|---|---|---|---|
| 3,669,190 | A * | 6/1972 | Sizer et al. | 166/387 |
| 5,560,426 | A | 10/1996 | Trahan et al. | 166/120 |
| 6,189,616 | B1 | 2/2001 | Gano et al. | 166/298 |
| 6,877,567 | B2 * | 4/2005 | Hirth | 166/382 |
| 7,090,005 | B2 * | 8/2006 | Smith et al. | 166/206 |
| 2003/0098164 | A1 * | 5/2003 | Hirth | 166/382 |
| 2006/0196678 | A1 * | 9/2006 | Connell et al. | 166/380 |

FOREIGN PATENT DOCUMENTS

| | | |
|---|---|---|
| EP | 0534732 | 3/1993 |
| EP | 1097760 | 5/2001 |
| WO | WO 9421882 A1 * | 9/1994 |
| WO | 98/22690 | 5/1998 |
| WO | 01/46551 | 6/2001 |

OTHER PUBLICATIONS

International Search Report dated Apr. 25, 2003.

* cited by examiner

*Primary Examiner*—Jennifer H Gay
*Assistant Examiner*—Daniel P Stephenson

(57) ABSTRACT

A device for performing a downhole operation in a wellbore formed into an earth formation comprising an actuator and a tool. The actuator is movable from a first configuration to a second configuration by the action of a selected increase of fluid pressure acting on the exterior of the actuator. The tool is arranged to be moved by the actuator so as to perform the downhole operation upon movement of the actuator from the first configuration to the second configuration.

10 Claims, 2 Drawing Sheets

DEVICE FOR PERFORMING A DOWNHOLE OPERATION

PRIORITY CLAIM

The present application claims priority on European Patent Application 01204031.7 filed on 23 Oct. 2001.

FIELD OF THE INVENTION

The present invention relates to a device for performing a downhole operation in a wellbore formed into an earth formation. Such downhole operation can be any operation in which a certain amount of mechanical work is required, such as expansion of a downhole tubular or injection of a selected fluid into the wellbore. Various systems have been proposed for performing such operations, all requiring some form of control of an actuation from surface. However, controlling such actuation system from surface is sometimes complicated due to the depth at which the operation is to be performed.

BACKGROUND OF THE INVENTION

WO-A-0146551 discloses a device according to the preamble of claim 1.

SUMMARY OF THE INVENTION

It is an object of the invention to provide an improved device for performing a downhole operation in a wellbore formed into an earth formation, which overcomes the problems of the prior art devices.

In accordance with the invention there is provided a device comprising:

an actuator movable from a first configuration to a second configuration by the action of a selected increase of fluid pressure acting on the exterior of the actuator; and a tool arranged to be moved by the actuator so as to perform said downhole operation upon movement of the actuator from the first configuration to the second configuration thereof.

Since the fluid pressure in the wellbore increases with depth in a known manner, the device can be accurately designed to perform the operation at the required depth whereby the required mechanical work can be delivered, for example, by the pressure difference between the exterior and the interior of the device. The pressure at the interior of the device then can be set at surface before lowering of the device into the wellbore.

In a preferred embodiment of the device, the actuator includes a reservoir containing a gas, the reservoir having a larger internal volume in said first configuration than in said second configuration, and wherein in said first configuration the gas pressure in the reservoir is lower than the fluid pressure in the wellbore at the depth where the tubular element is to be expanded.

Suitably, when the actuator is in the first configuration the gas pressure in the reservoir is substantially equal to atmospheric pressure.

In an attractive embodiment of the device, the device is used to expand a tubular element in the wellbore, whereby the tool is an expander arranged to be moved axially through the tubular element by the actuator upon movement of the actuator from the first configuration to the second configuration thereof.

In another attractive embodiment, the device is used for injecting a fluid compound in the wellbore, whereby the tool is an injector arranged to inject the fluid compound into the wellbore upon movement of the actuator from the first configuration to the second configuration thereof.

BRIEF DESCRIPTION OF THE DRAWING

The invention will be described hereinafter by way of example in more detail, with reference to the accompanying drawings in which.

DETAILED EMBODIMENT OF THE INVENTION

Figure 1:
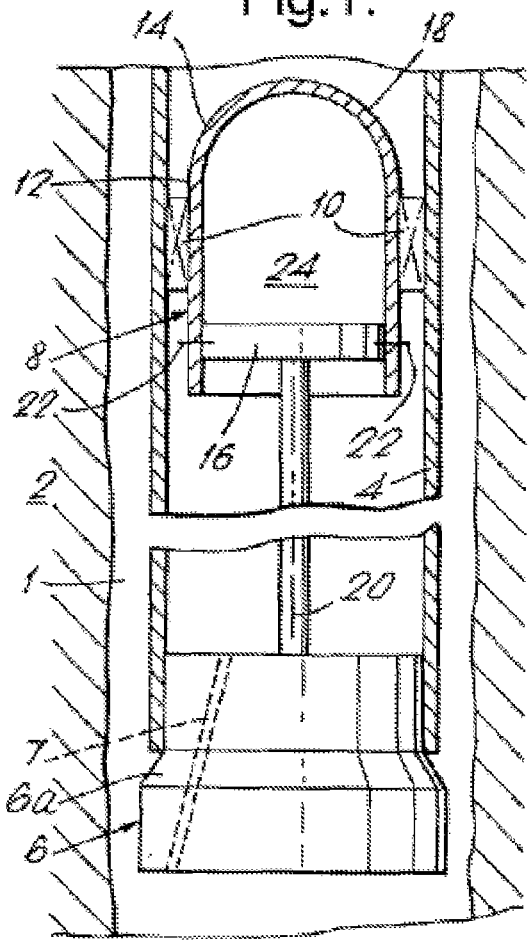
FIG. 1 schematically shows, in longitudinal section, a first embodiment of the device according to the invention.

Referring to FIG. 1 there is shown a wellbore 1 formed in an earth formation 2, the wellbore 1 being filled with a suitable wellbore fluid (e.g. drilling fluid). A tubular element in the form of a casing 4 extends into the wellbore 1, the casing 4 being radially expandable. An expander 6 having conical portion 6*a* for expanding a lower portion of the casing 4, is arranged below the lower end of the casing 4. The expander 6 is provided with a through-bore 7 which provides fluid communication between opposite ends of the expander 6. An actuator 8 is arranged within the casing 4 a short distance above the expander 6, and is fixedly connected to the casing 4 by releasable fixing means 10. The actuator 8 includes a cylinder/piston arrangement 12 with cylinder 14 and piston 16, the cylinder 14 being closed at its upper end by end wall 18. The piston 16, which is axially movable through the cylinder 14, is connected to the expander 6 by means of a releasable connecting rod 20. The piston 16 is temporarily axially restrained in the cylinder 14 by means of shear pins 22 which are designed to shear-off at a selected pressure difference across the piston 16. The space 24 enclosed by the cylinder 14, the end wall 18 and the piston 16 is filled with a gas (e.g. air) at atmospheric pressure. The aforementioned pressure difference at which the shear pins 22 shear-off is selected equal to the difference between atmospheric pressure and the hydraulic fluid pressure in the wellbore 1 at the depth where the lower casing portion is to be expanded.

During normal operation the casing 4, with the actuator 8 arranged therein and the expander suspended below the casing 4 by connecting rod 20, is lowered into the wellbore 1. As lowering of the casing 4 proceeds the pressure difference across the piston 16 increases due to increasing hydraulic fluid pressure in the wellbore 1. In this respect it is to be noted that the through-bore provides fluid communication between the wellbore fluid and the outer surface of the piston 16. When the lower end of the casing 4 arrives at the selected depth, the pressure difference across the piston 16 equals the selected pressure difference so that the shear pins 22 shear-off, and consequently the piston 16 is moved axially into the cylinder 14. By virtue of this movement, the piston 16 pulls the expander 6 into the lower end part of the casing 4 as a result of which the lower casing part is radially expanded. Thereafter the fixing means 10 of the actuator 8 is released, the connecting rod 20 is released from the expander 6, and the actuator 8 and connecting rod 20 are removed upwardly through the casing 4. If desired the casing 4 can thereafter be further expanded in any suitable manner.

Figure 2:
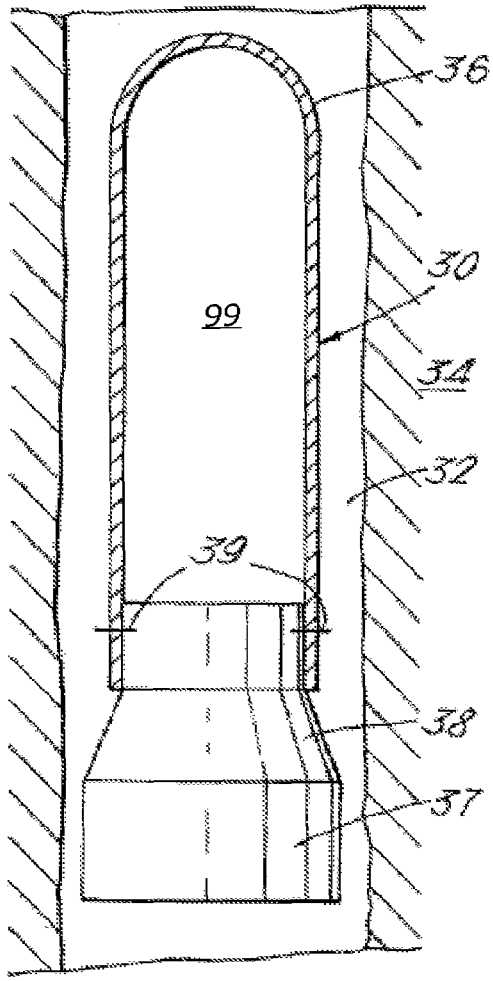
FIG. 2 schematically shows, in longitudinal section, a second embodiment of the device according to the invention.

In FIG. 2 is shown an expandable tubular plug 30 arranged in wellbore 32 formed in an earth formation 34, the wellbore 1 being filled with drilling fluid. The plug 30 is closed at its upper end by end wall 36, and is at its lower end provided with an expander 37 having a conical portion 38 for expanding the plug upon inward axial movement of the expander 37 into the tubular plug 30. The expander 37 is temporarily axially restrained to the plug 30 by shear pins 39 which are designed to shear-off at a selected pressure difference across the expander 37. A space 99 is enclosed by the tubular plug 30, the end wall 36 and the expander 37, which space is filled with air at atmospheric pressure. The pressure difference at which the shear pins 39 shear-off equals the difference between atmospheric pressure and the hydraulic fluid pressure in the wellbore 34 at the depth where the plug 30 is to be expanded.

During normal operation the tubular plug 30 is lowered into the wellbore 32 with the expander 37 connected thereto in the position shown. As lowering of the plug 30 proceeds the pressure difference across the expander 37 increases due to increasing hydraulic fluid pressure in the wellbore 1. When the tubular plug 37 arrives at the selected depth, the pressure difference across the expander 37 equals the selected pressure difference so that the shear pins 39 shear-off. Consequently the expander 37 is moved axially into the tubular plug 37 due to the axial pressure difference across the expander 37. The expander 37 thereby radially expands the plug 30 against the wall of the wellbore 1 so as to seal the wellbore portions above and below the expanded plug 30 from each other.

Figure 3A:
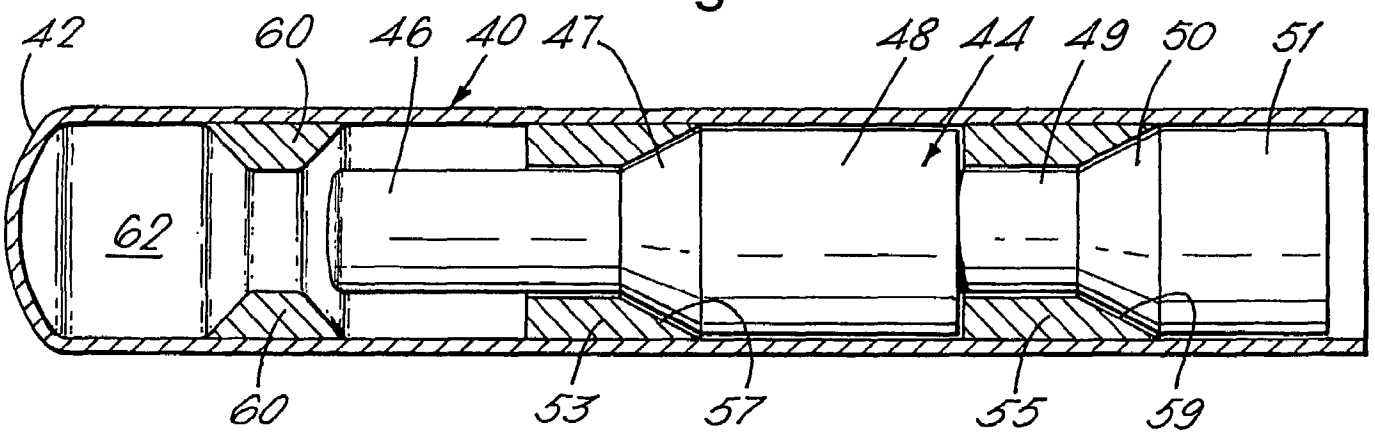
FIG. 3A schematically shows, in longitudinal section, a third embodiment of the device according to the invention including a bridge plug before radial expansion thereof.

In FIG. 3A is shown another expandable tubular plug 40 arranged in a wellbore (not shown) formed in an earth formation, which wellbore is filled with a suitable wellbore fluid. The plug 40 is closed at its front end by end wall 42, and is internally provided with an expander 44 having the following subsequent parts: a nose part 46 of reduced diameter, a first conical part 47, a first cylindrical part 48, an intermediate part of reduced diameter 49, a second conical part 50, and a second cylindrical part 51. The first and second cylindrical parts 48, 51 have a diameter slightly smaller than the inner diameter of the tubular plug 40, and are sealed relative the inner surface of the tubular plug 40 by suitable seals (not shown). The plug is internally provided with two expandable rings 53, 55 (e.g. made of elastomer) fixedly connected to the inner surface of the plug 40, whereby ring 53 extends around the nose part 46 of expander 44 and ring 55 extends around the intermediate part 49 of expander 44. Ring 53 has, at the side of conical part 47, a conical surface 57 complementary to the conical surface of part 47. Similarly, ring 55 has, at the side of conical part 50, a conical surface 59 complementary to the conical surface of part 50. A guide ring 60 for guiding the nose part 46 therethrough, is fixedly arranged in a front end part of the plug 40. A space 62 filled with air at atmospheric pressure is enclosed by the tubular plug 40, the end wall 42, and the nose part 46 of the expander. The assembly of tubular plug 40, rings 53, 55 and expander 44 is designed such that the expander moves axially inward into the tubular plug 40 (and thereby expands the rings 53, 55 and the portions of the plug 40 opposite said rings) when the pressure difference across the expander 44 equals the difference between atmospheric pressure and the hydraulic fluid pressure in the wellbore at the depth where the plug 40 is to be expanded.

Figure 3B:
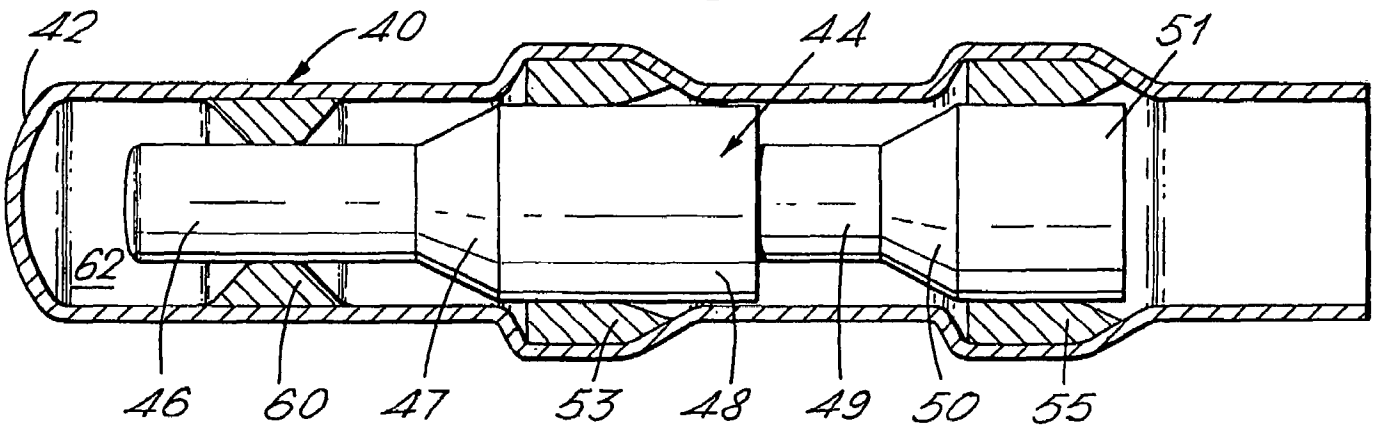
FIG. 3B schematically shows the third embodiment with the bridge plug after radial expansion thereof.

Referring further to FIG. 3B, during normal operation the tubular plug 40 is lowered into the wellbore with the expander 44 arranged therein. During lowering of the plug 40 proceeds the pressure difference across the expander 44 increases due to increasing hydraulic fluid pressure in the wellbore. When the tubular plug 40 arrives at the selected depth, the pressure difference across the expander 44 becomes equal the pressure difference needed to move the expander 44 axially inward into the plug 40. Consequently the expander 44 moves axially inward into the plug 40 and thereby expands the rings 53, 55 and the portions of the plug 40 opposite the rings against the wellbore wall so that the wellbore portions above and below the expanded plug 40 become sealed from each other. The plug 40 and the expander 44 after the expansion process are shown in FIG. 3B.

Figure 4:
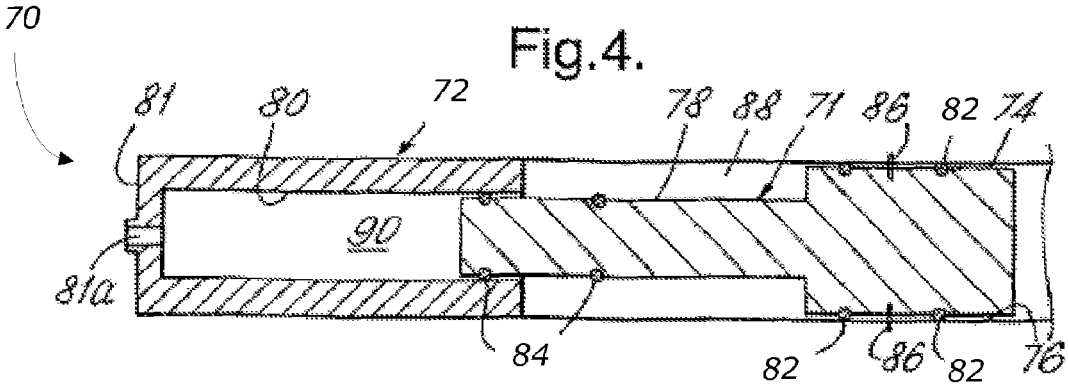
FIG. 4 schematically shows, in longitudinal section, a fourth embodiment of the device according to the invention.

In FIG. 4 is shown another embodiment of the device of the invention, used to inject a chemical compound into a wellbore (not shown). The device includes a cylinder/piston assembly 70 including a piston 71 axially movable through a cylinder 72. The piston 71 includes a large diameter portion 74 positioned in a corresponding large internal diameter portion 76 of the cylinder 72, and a small diameter portion 78 extending partly into a corresponding small internal diameter portion 80 of the cylinder 72. The large and small diameter portions 76, 80 of the cylinder are of sufficient length to allow the piston 71 to move over a selected stroke inwardly into the cylinder 72. The small internal diameter portion 80 of the cylinder 72 has an end wall 81 provided with nozzle 81*a*. Suitable seals 82, 84 are provided to seal the piston portions 74, 78 to the respective cylinder portions 76, 80. Furthermore, the piston 71 is temporarily restrained in the cylinder 72 by shear pins 86 which are designed to shear-off at a selected pressure difference across the cylinder 72. An annular space 88 is formed between the small diameter portion 78 of the piston 71 and the inner surface of the large diameter portion 76 of the cylinder 72, which space 88 is filled with air at atmospheric pressure. A fluid chamber 90 filled with a selected chemical compound (e.g. a cement hardener) is formed in the small internal diameter portion 80 of the cylinder 72, between the piston 71 and the end wall 81. The pressure difference across the piston 71 at which the shear pins 86 shear-off, is selected such that shearing-off occurs when the difference between the hydraulic fluid pressure in the wellbore and atmospheric pressure equals the selected pressure difference across the piston 71.

During normal operation the cylinder/piston assembly 70 is lowered into the wellbore. As lowering proceeds the pressure difference across the piston 71 increases due to increasing hydraulic fluid pressure in the wellbore. When the assembly 70 arrives at the selected depth, the pressure difference across the piston 71 equals the selected pressure difference so that the shear pins 86 shear-off. Consequently the piston 71 is moved axially into the cylinder 72. By virtue of this movement, the small diameter portion 78 of the piston 71 ejects the chemical compound in chamber 90 through the nozzle 81*a* into the wellbore. In an alternative arrangement (not shown) the piston can be used to eject different compounds from different containers, which compounds react when intermixed.

In the above detailed description the actuator moves from its first configuration to its second configuration by virtue of the device arriving at a position in the wellbore where the fluid pressure due to hydrostatic or hydrodynamic fluid head has a selected magnitude. In an alternative arrangement the actuator can be set to move from the first to the second configuration at a fluid pressure which is somewhat higher than the fluid pressure due to hydrostatic or hydrodynamic head. After the device has been lowered to the desired depth, the fluid pressure in the wellbore can be increased so as to activate the actuator by increasing the wellbore pressure at surface, for example by closing the blowout preventer (BOP) and operating the fluid pumps.

Instead of using shear pins as described above, a spring loaded device can be used to unlock the actuator, for example a spring loaded device as used in pressure relief valves.

While the illustrative embodiments of the invention have been described with particularity, it will be understood that various other modifications will be readily apparent to, and can be easily made by one skilled in the art without departing from the spirit of the invention. Accordingly, it is not intended that the scope of the following claims be limited to the examples and descriptions set forth herein but rather that the claims be construed as encompassing all features which would be treated as equivalents thereof by those skilled in the art to which this invention pertains.

I claim:

1. A device for performing a downhole operation in a wellbore formed into an earth formation, the device comprising:

an actuator movable from a first configuration to a second configuration by the presence of a selected hydraulic fluid pressure in the wellbore acting on the exterior of the actuator, the actuator being prevented from movement until the pressure in the wellbore equals the selected hydraulic fluid pressure; and a tool arranged to be moved by the actuator so as to perform said downhole operation upon movement of the actuator from the first configuration to the second configuration thereof, wherein the actuator is arranged to be released from the first configuration when the hydraulic pressure in the wellbore equals the selected pressure;

wherein the device is a device for expanding a tubular element in the wellbore and the tool is an expander arranged to be moved axially through the tubular element by the actuator upon movement of the actuator from the first configuration to the second configuration thereof.

2. The device of claim 1 , wherein the expander is arranged to be moved axially through an end portion of the tubular element by the actuator upon movement of the actuator from the first configuration to the second configuration thereof.

3. The device of claim 1, wherein said tubular element is a bridge plug arranged to plug the wellbore when the expander has moved axially through the tubular element by the actuator.

4. The device of claim 1, wherein the tubular element is internally provided with at least one expander ring having a central opening, and wherein the expander is arranged to pass through said central opening upon axial movement of the expander through the tubular element, whereby the expander expands the expander ring.

5. A device for performing a downhole operation in a wellbore formed into an earth formation, the device comprising:

an actuator movable from a first configuration to a second configuration by the presence of a selected hydraulic fluid pressure in the wellbore acting on the exterior of the actuator, the actuator being prevented from movement until the pressure in the wellbore equals the selected hydraulic fluid pressure; and a tool arranged to be moved by the actuator so as to perform said downhole operation upon movement of the actuator from the first configuration to the second configuration thereof, wherein the actuator is arranged to be released from the first configuration when the hydraulic pressure in the wellbore equals the selected pressure wherein the device is a device for expanding a tubular element in the wellbore, and the tool is an expander arranged to be moved axially through the tubular element by the actuator upon movement of the actuator from the first configuration to the second configuration thereof; and wherein the actuator comprises a reservoir containing a gas, the reservoir having a larger internal volume in said first configuration than in said second configuration, and wherein in said first configuration the gas pressure in the reservoir is lower than the fluid pressure in the wellbore at the depth where the tubular element is to be expanded.

6. The device of claim 5, wherein in said first configuration the gas pressure in the reservoir is substantially equal to atmospheric pressure.

7. A device for performing a downhole operation in a wellbore formed into an earth formation, the device comprising:

an actuator movable from a first configuration to a second configuration by the presence of a selected hydraulic fluid pressure in the wellbore acting on the exterior of the actuator, the actuator being temporarily restrained in the first configuration; and a tool arranged to be moved by the actuator so as to perform said downhole operation upon movement of the actuator from the first configuration to the second configuration thereof, wherein the actuator is arranged to be released from the first configuration when the hydraulic pressure in the wellbore equals the selected pressure wherein the device is a device for expanding a tubular element in the wellbore, and the tool is an expander arranged to be moved axially through the tubular element by the actuator upon movement of the actuator from the first configuration to the second configuration thereof;

wherein the actuator comprises a reservoir containing a gas, the reservoir having a larger internal volume in said first configuration than in said second configuration;

wherein in said first configuration the gas pressure in the reservoir is lower than the fluid pressure in the wellbore at the depth where the tubular element is to be expanded; and wherein the reservoir is formed by a cylinder/piston arrangement including a piston axially movable within a cylinder, and wherein the actuator is arranged to move from the first configuration to the second configuration by movement of the piston into the cylinder.

8. The device of claim 7, wherein the piston is connected to the expander so that said movement of the piston into the cylinder results in axial movement of the expander through the tubular element.

9. A device for performing a downhole operation in a wellbore formed into an earth formation, the device comprising:

an actuator movable from a first configuration to a second configuration by the presence of a selected hydraulic fluid pressure in the wellbore acting on the exterior of the actuator, the actuator being temporarily restrained in the first configuration; and a tool arranged to be moved by the actuator so as to perform said down hole operation upon movement of the actuator from the first configuration to the second configuration thereof, wherein the actuator is arranged to be released from the first configuration when the hydraulic pressure in the wellbore equals the selected pressure;

wherein the device is a device for expanding a tubular element in the wellbore and the tool is an expander arranged to be moved axially through the tubular element by the actuator upon movement of the actuator from the first configuration to the second configuration thereof; and wherein said tubular element is a bridge plug arranged to plug the wellbore when the expander has moved axially through the tubular element by the actuator.

10. A device for performing a downhole operation in a wellbore formed into an earth formation, the device comprising:

an actuator movable from a first configuration to a second configuration by the presence of a selected hydraulic fluid pressure in the wellbore acting on the exterior of the actuator, the actuator being temporarily restrained in the first configuration; and a tool arranged to be moved by the actuator so as to perform said downhole operation upon movement of the actuator from the first configuration to the second configuration thereof, wherein the actuator is arranged to be released from the first configuration when the hydraulic pressure in the wellbore equals the selected pressure;

wherein the device is a device for expanding a tubular element in the wellbore and the tool is an expander arranged to be moved axially through the tubular element by the actuator upon movement of the actuator from the first configuration to the second configuration thereof; and wherein the tubular element is internally provided with at least one expander ring having a central opening, and wherein the expander is arranged to pass through said central opening upon axial movement of the expander through the tubular element, whereby the expander expands the expander ring.

* * * * *